US009192813B2

(12) United States Patent
Ross

(10) Patent No.: US 9,192,813 B2
(45) Date of Patent: Nov. 24, 2015

(54) EXERCISE STEP APPARATUS

(75) Inventor: Adam L. Ross, West Chester, OH (US)

(73) Assignee: Exemplar Design, LLC, Mason, OH (US)

( * ) Notice: Subject to any disclaimer, the term of this patent is extended or adjusted under 35 U.S.C. 154(b) by 807 days.

(21) Appl. No.: 13/367,644

(22) Filed: Feb. 7, 2012

(65) Prior Publication Data

US 2012/0202652 A1 Aug. 9, 2012
US 2013/0045840 A2 Feb. 21, 2013

Related U.S. Application Data

(60) Provisional application No. 61/440,099, filed on Feb. 7, 2011.

(51) Int. Cl.

| | |
|---|---|
| ***A63B 22/04*** | (2006.01) |
| ***A63B 22/00*** | (2006.01) |
| ***A63B 71/00*** | (2006.01) |
| ***A63B 23/04*** | (2006.01) |

(52) U.S. Cl.
CPC ..... *A63B 23/0458* (2013.01)

(58) Field of Classification Search
CPC ..... A63B 23/04; A63B 23/0405; A63B 23/0458; A63B 23/10; A63B 21/00; A63B 21/0047; A63B 21/00185; A63B 21/068; A63B 22/04; A63B 22/0046; A63B 23/0464; A63B 23/0046; A63B 69/035; A63B 2023/011; A63B 2225/093
USPC ..... 482/23, 51, 52, 74, 77, 79, 131, 142
See application file for complete search history.

(56) References Cited

U.S. PATENT DOCUMENTS

| | | | | |
|---|---|---|---|---|
| 4,603,851 | A * | 8/1986 | Russell | 482/79 |
| 5,050,861 | A * | 9/1991 | Thomas et al. | 482/52 |
| 5,125,646 | A | 6/1992 | Wilkinson | |
| D330,057 | S | 10/1992 | Saunders et al. | |
| 5,162,028 | A | 11/1992 | Wilkinson | |
| 5,169,360 | A | 12/1992 | Saunders | |
| 5,176,596 | A * | 1/1993 | Ullman | 482/52 |
| 5,290,210 | A * | 3/1994 | Hand et al. | 482/51 |
| 5,507,708 | A * | 4/1996 | Ma | 482/52 |
| 5,638,913 | A * | 6/1997 | Blum | 182/33 |
| 5,645,511 | A * | 7/1997 | Le Roux et al. | 482/52 |
| 5,651,753 | A | 7/1997 | Wilkinson | |
| 5,656,000 | A * | 8/1997 | Russell | 482/52 |
| 5,660,257 | A | 8/1997 | Douglas | |
| 5,842,955 | A | 12/1998 | Wilkinson | |
| 2002/0177509 | A1 | 11/2002 | Rogers et al. | |

* cited by examiner

*Primary Examiner* — Loan H Thanh
*Assistant Examiner* — Nyca T Nguyen
(74) *Attorney, Agent, or Firm* — Baker & Hostetler LLP

(57) ABSTRACT

A step apparatus is disclosed for individual training or group fitness classes. The step apparatus may simultaneously contain a plurality of step heights for a dynamic work out. The platform heights may be quickly adjusted to user preference. The adjustable settings may be self-contained within a single unit, or alternate pieces may be provided for additional variation. The step apparatus has a frame and a plurality of step platform units, with each platform unit having two height settings.

8 Claims, 5 Drawing Sheets

EXERCISE STEP APPARATUS

CROSS-REFERENCE TO RELATED APPLICATION

This application claims the benefit of U.S. Provisional Application No. 61/440,099, filed Feb. 7, 2011, which is hereby incorporated by reference.

BACKGROUND

The present disclosure relates to an exercise device, and more particularly to a stepper apparatus used for individual or group exercise. Some example step apparatus according to the present invention may provide different height step platforms in one unit or for the purpose of group or individual exercises.

SUMMARY

Stepper apparatuses are generally disclosed. Some example embodiments may include methods, apparatus, and/or systems associated with stepper apparatus.

In an exemplary embodiment, the variable elevated and height adjustable step apparatus may be comprised of three parts, including an elevated step frame and two flippable step platform units. The step frame provides the basic boundaries of the step, and has a space inside of the frame for flippable step platform unit placement. There is a ledge on the inside of the frame for the platform units to sit. A center-wall extending across the frame opening may separate and stabilize adjacent flippable platform units.

The flappable step platform units may be removed, flipped, and reseated so that multiple heights can be used with the same units. The platform units may also be modular so that they may be removed and replaced with a different platform unit having a step of a different height. Another possible variation is the number of platform units which can be used in the frame at one time. For example, there may be one or three platform units seated within the frame instead of two. Any number of platform units may be set within a single frame as long as the steps are able to fit adjacently within the frame.

Some example stepper apparatus include a base structure set on the floor comprising an elevated frame, the frame having vertical side walls, a support ledge along the inside of the frame from the vertical side walls, and at least one flippable step platform unit received within the frame. The flippable step platform unit comprises a first box, which provides a first step platform surface. This first box is attached to a second box in a stacked formation, where the second box provides a second opposed step platform surface. When the platform unit is seated in the elevated frame with the first platform surface facing upward, the first platform surface will be at a first height. When the platform unit is flipped and seated in the elevated frame with the second platform surface facing upward, the second platform surface will be at a second height, different from the first height. The first box may have a rectangular cross section and has a length and width sized to rest on the ledge within the frame, and a height corresponding to the distance from the ledge to the top of the frame. The dimensions of the first box correspond to the space in the frame from the ledge to the top of the frame. The second box has a length and width sized to pass through the frame, and a maximum height of the distance from the ledge to the bottom of the frame. Accordingly, in either flipped orientation, it will be the first box that is seated on the ledge. When the first box faces upward the exercise surface provided by the first box is flush with the top of the frame. When flipped, the exercise surface provided by the second box is elevated above the frame.

The step apparatus has several configurations, or positions. In a first position, the second boxes of the two flippable step platform units are situated beneath the first box facing down, therefore within the frame. The platform used is that of the first box, with a step height of the frame height. In a second position, one or more flippable step platform units may be flipped to reveal the second step box, and provide a step platform at a second height. Here, the second platform height is above the frame height. The stepper apparatus may have both of the flippable step platform units flipped up so the apparatus can be used at the second height, the platform created by the second box.

The stepper apparatus may have two or more adjacent step platform units, or it may have one step platform unit only, which spans the length and width of the frame. In the case of a plurality (such as two or three) of flippable step platform units, each unit may be set in the frame adjacent to each other as long as they are able to fit within the frame, and preferably filling the span of the frame perfectly. Each of the second boxes of the plurality of step platform units may have different heights, cross sections, or platform tilts.

In an exemplary embodiment, the second platform box has a rectangular cross section, but it may also have a triangular vertical cross section to create a tilted step. Second platform boxes of the same or different heights or tilts may be used at the same time.

The ledge is typically elevated at a sufficient height to allow a second step box to have multiple height variations. A divider wall may be provided across the frame opening to separate the adjacent flippable step platform units. The divider wall may extend the ledge across the frame opening helping to support the step platform units, and forming support bridges.

The frame is adapted to stand on a floor for use, and the bottom of the frame, or legs extending from the frame, may include rubber pieces in contact with the floor to provide friction to help keep the step apparatus stable in one place while in use. The step apparatus is preferably made from a rigid material, such as plastic. The step platform exercise surfaces may be covered with a non-slip or rubberized surface. The step surfaces may have a diamond grid, or other pattern, which provides increased friction for the user when in use. The frame generally encloses a polygon, and is, in exemplary embodiments, rectangular.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope. The disclosure will be described with additional specificity and detail through use of the accompanying drawings.

In the drawings.

DETAILED DESCRIPTION

Figure 1:
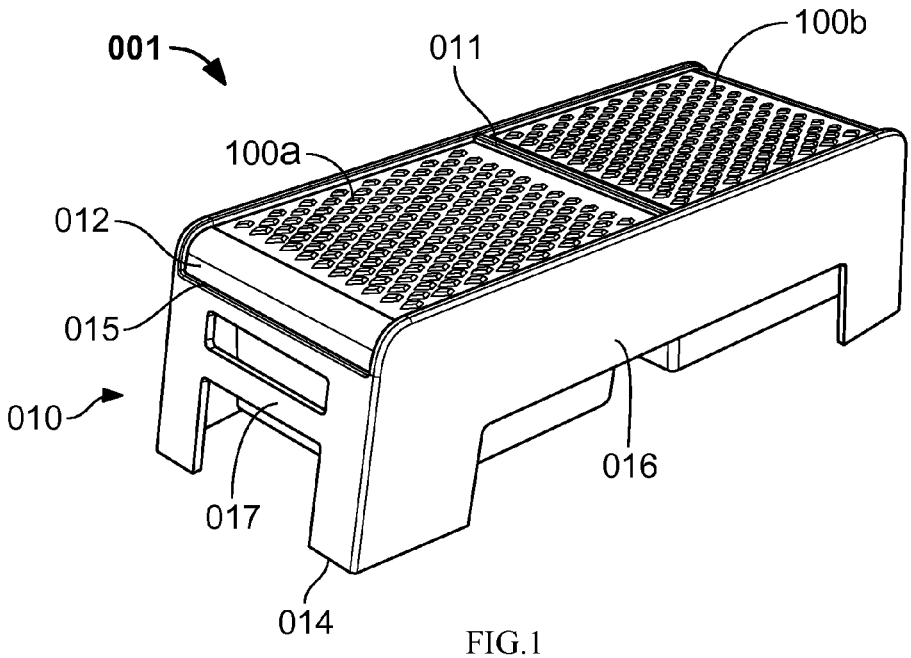
FIG. 1 shows a perspective view of a two unit step apparatus, where the step surfaces are flush with the frame.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

The present disclosure pertains, inter alia, to a step apparatus with variable height step platforms, with height settings which can be changed quickly, and without the necessity of additional pieces that may be dangerous in an exercise class situation.

Figure 2:
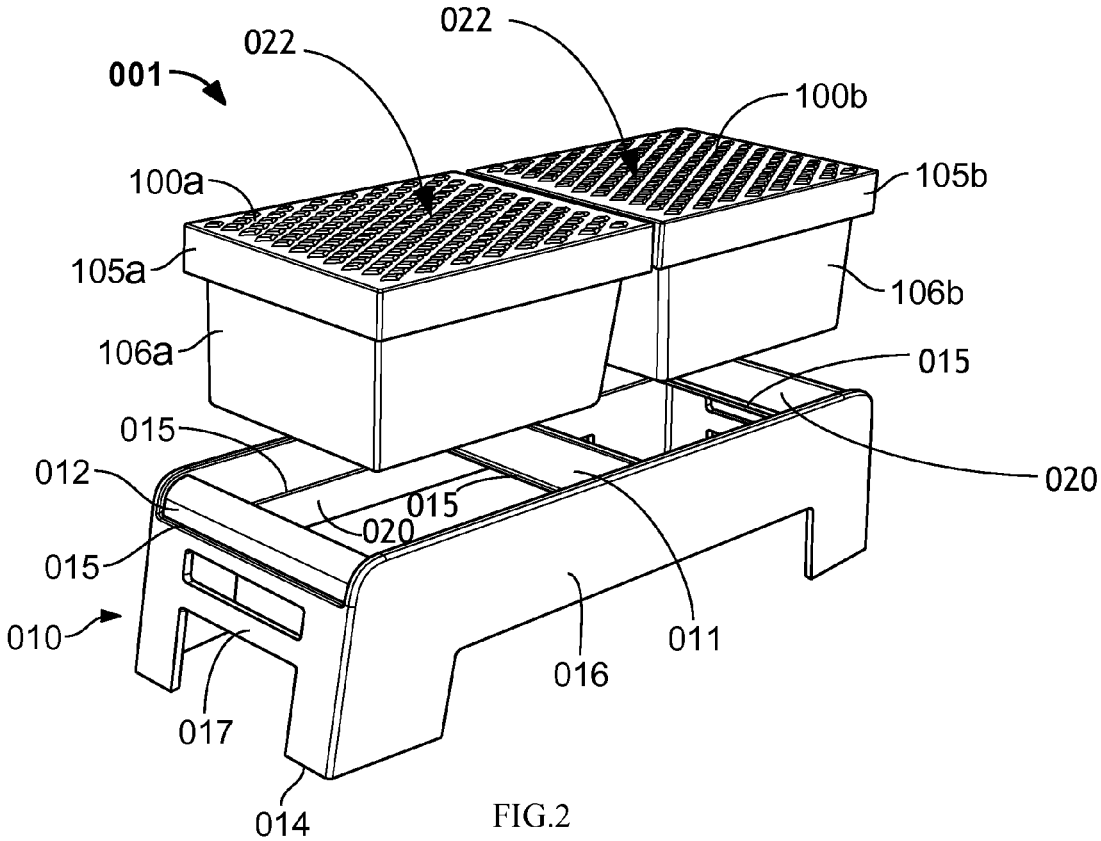
FIG. 2 shows an exploded perspective view of a two unit step apparatus, where the flippable step platform units are lifted out the frame.

FIG. 1 shows an exemplary embodiment of the step apparatus 001, in a first position with two platform units 100*a* and 100*b* fitted and seated inside the frame 010. As shown in FIG. 2, the frame 010 has vertical inner side walls 020, and a lip, or a ledge 015 extending from the vertical side walls 020 within the frame 010. The ledge 015 supports flippable step platform units 100*a* and 100*b*. It is not necessary that the ledge 015 extend completely along inner periphery of the frame (e.g., it can be broken up into multiple sections or segments). The step platform unit 100 includes primary box 105 which has a length and width sized to rest on the frame ledge 015 so that the units 100 are supported within the frame 010. This box 105 may simply provide a platform and the seats for the ledge, without being a "box"—its height corresponds to the distance from the ledge 015 to the top of the frame 010, and may simply be one rigid sheet. The top surface 022 of box 105 provides a flat step platform, and its length and width is sized to be supported by the ledge 015 within the frame 010. In this position, the flippable step platform unit 100 provides a step platform surface 022 of box 105, at a step height flush to the top of the frame 010.

As shown in FIG. 1 and FIG. 2, the frame 010 has outer walls 016, and may also have legs 014; however, legs 014 are not required for this invention to work properly. The frame 010 need not have solid walls 016 throughout, and may have only connectors or a partial wall 017 on some sides. The frame 010 may have rounded sides 012 for a safer, more aesthetic step. These features may be incorporated as long as they do not hinder the functions of the steps.

As shown in FIG. 1 and FIG. 2, a separator wall 011 may separate the two platform units 100*a* and 100*b*, and help stabilize the step platform units 100 against the frame 010. The separator wall 011 also has the ledge 015 running along the inside, allowing for unbroken support ledges 015 along the inside of the frame 010, and providing extra support spanning across the length of the stepper apparatus 001.

Figure 3:
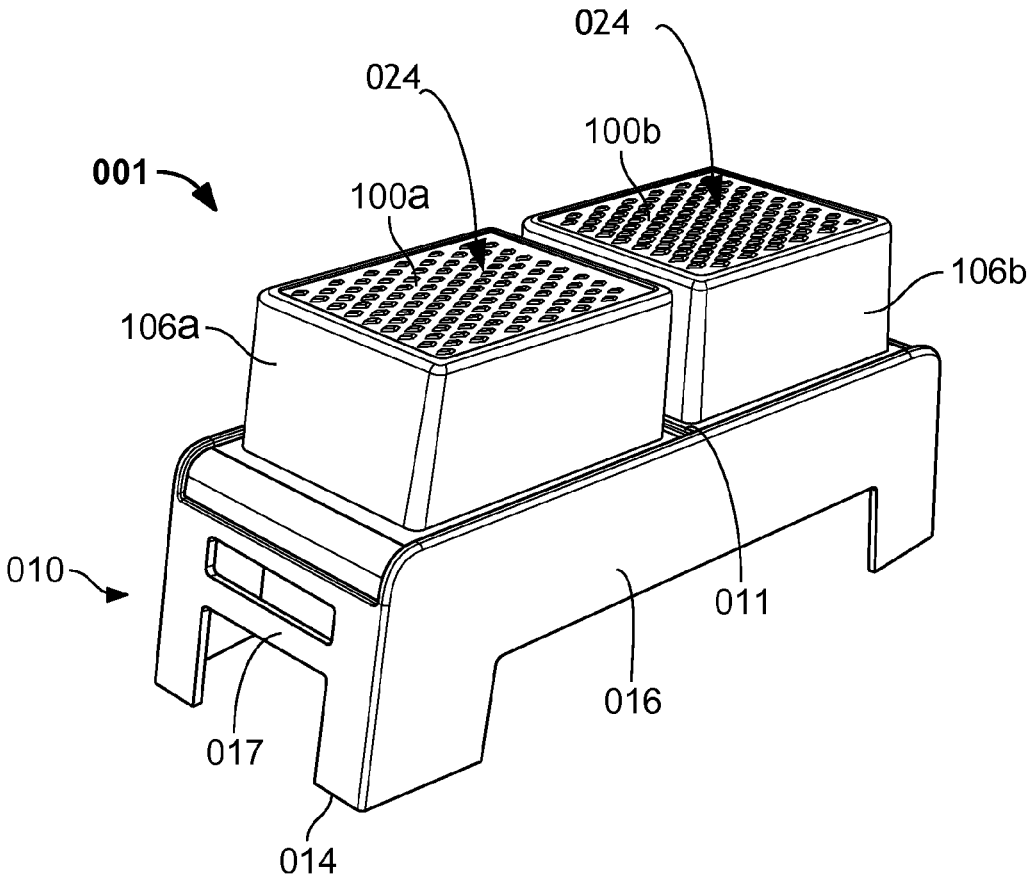
FIG. 3 shows a perspective view of a two unit step apparatus, where the flippable step platform units are flipped to form a step surface with a height above the frame.

FIG. 3 shows two flippable platform units 100*a* and 100*b* within the step frame 010, both flipped to the second setting, with the second boxes 106*a* and 106*b* in the upward facing in-use position. In this flipped position, the second boxes 106*a* and 106*b* provide step platform surfaces 024 that are elevated above the frame. When a frame-height step is desired, box 105 faces up and is situated over box 106, which is within the frame. When the unit 100 is flipped so that box 105 is under box 106, the platform 106 rises above the step frame 010 and provides an alternate height step in the step apparatus 001. In this flipped orientation, the first box 105 is still the box seated on the ledge 015 (just flipped over).

Figure 4:
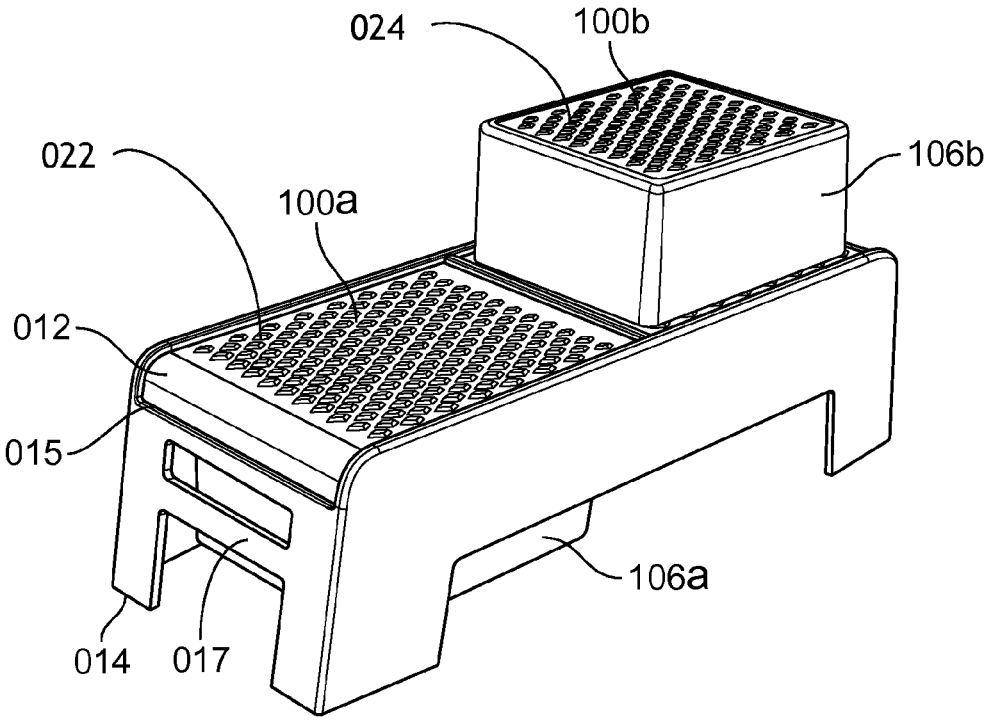
FIG. 4 shows a perspective view of a two unit step apparatus, where one step surface is flush with the frame and a second step platform unit is flipped to provide a step surface of a second height, above the frame.

FIG. 4 shows one step platform unit 100*a* with box 105 flipped up to be used as a step platform 022 at the frame height, and a second step platform 100*b* with step box 106 flipped up to be used as a platform 024 at an elevated height above the frame height. In this configuration, a step exercise may be performed at two heights, for two intensities.

Figure 5:
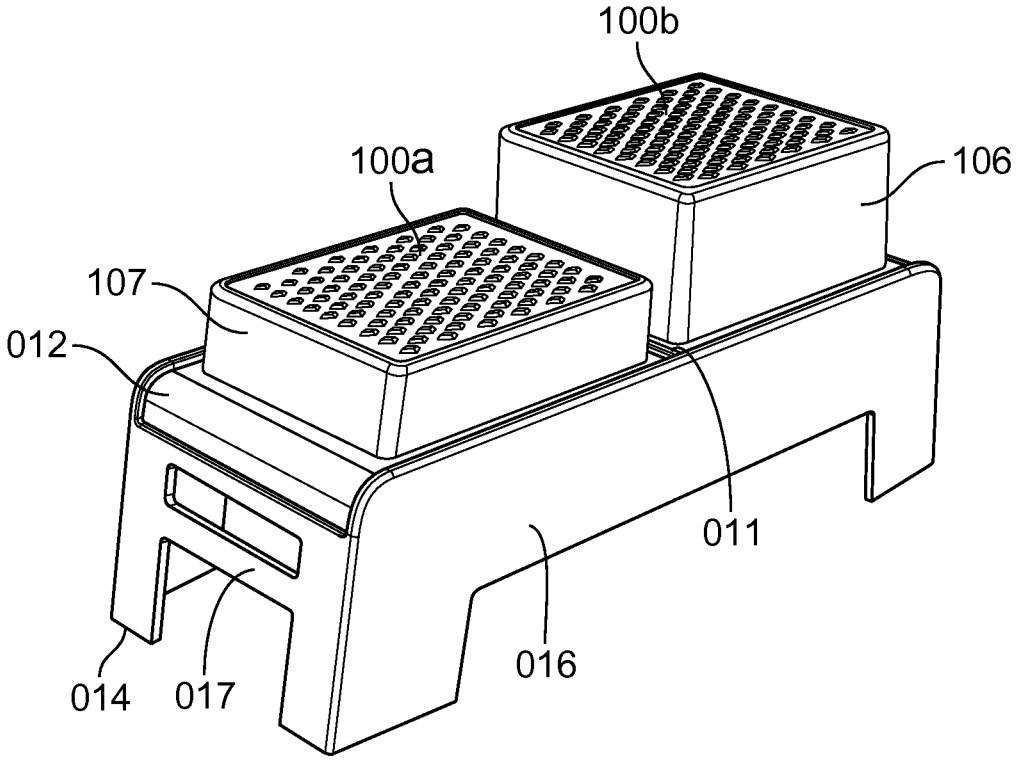
FIG. 5 shows a perspective view of a two unit step apparatus, where both step units are flipped, where the step units provide two different height step surfaces above the frame.

FIG. 5 shows both flippable step units 100*a* and 100*b* in frame 010 flipped to the second position. Unit 100*a* has second step platform box 107 and unit 100*b* has second step platform box 106, both of which have different heights.

Figure 6:
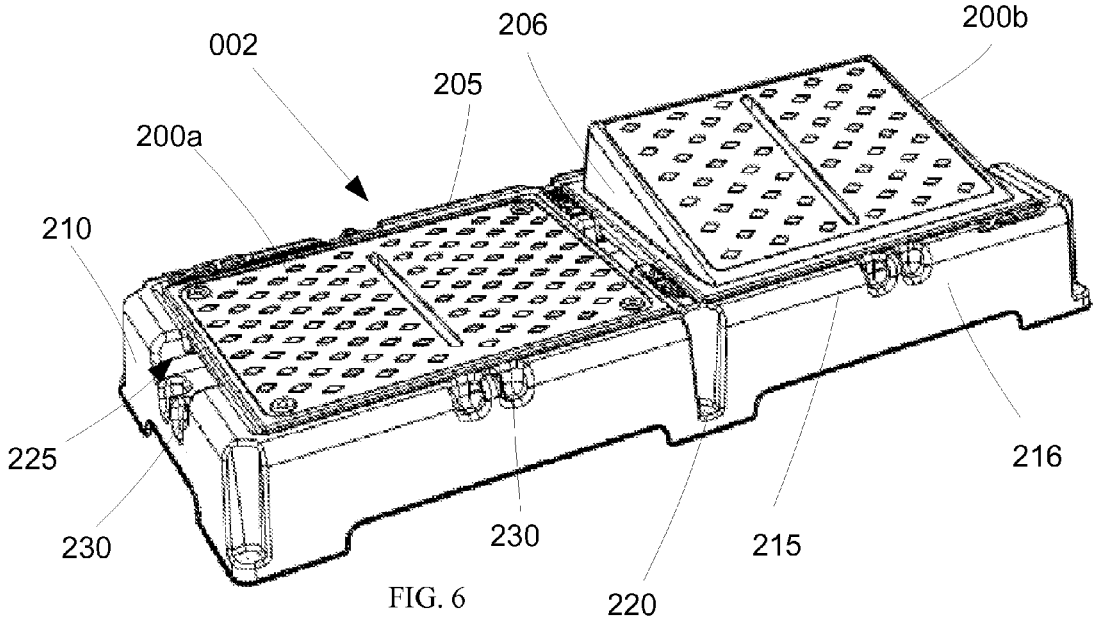
FIG. 6 shows a perspective view of a two unit step apparatus, where one platform is flush with the frame, and a step unit is flipped to provide a sloped, or tilted, exercise platform.

FIG. 6 shows an alternate embodiment of the step apparatus 002 with a first flippable step platform 200*a* in the first position with box 205 facing up, and the second flippable step platform unit 200*b* in the alternate position, with box 206 facing up as the usable step platform. In this embodiment, the box 206 includes a triangular vertical cross section to provide a tilted or sloped exercise platform surface 250 (see FIG. 7). In FIG. 6, the frame 210 with walls 216 is slightly shorter than the frame 010 in FIGS. 1-5, and has access ports 225 to easily access the flippable step platform unit 200 to remove or flip (see, also, FIG. 8). However, the sloped step 200, the lower frame 210, and the access ports 225 can be implemented independently. Rubber feet 220 which extend through the frame 210 can be seen at intermittent points along the base, or frame 210. The ledge 215 operates the same way as with other configurations.

Figure 7:
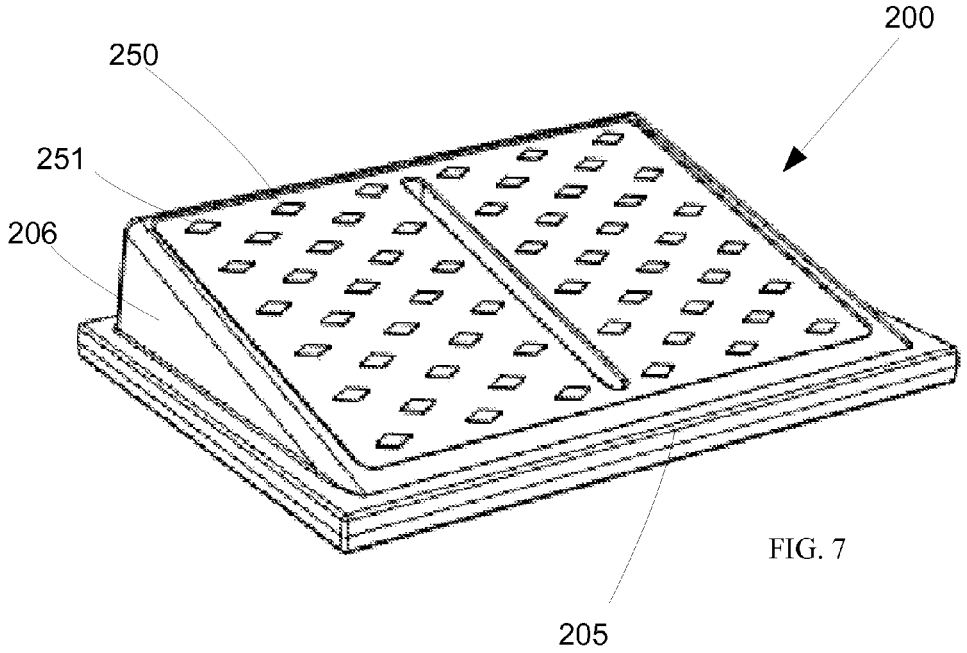
FIG. 7 shows a perspective view of the step platform unit with a tilted second platform surface in greater detail.

FIG. 7 shows the step platform box 100 with box 108 in detail. The tilted step surface 250 may be covered with a non-skid rubber and/or a non-skid pattern 251.

Figure 8:
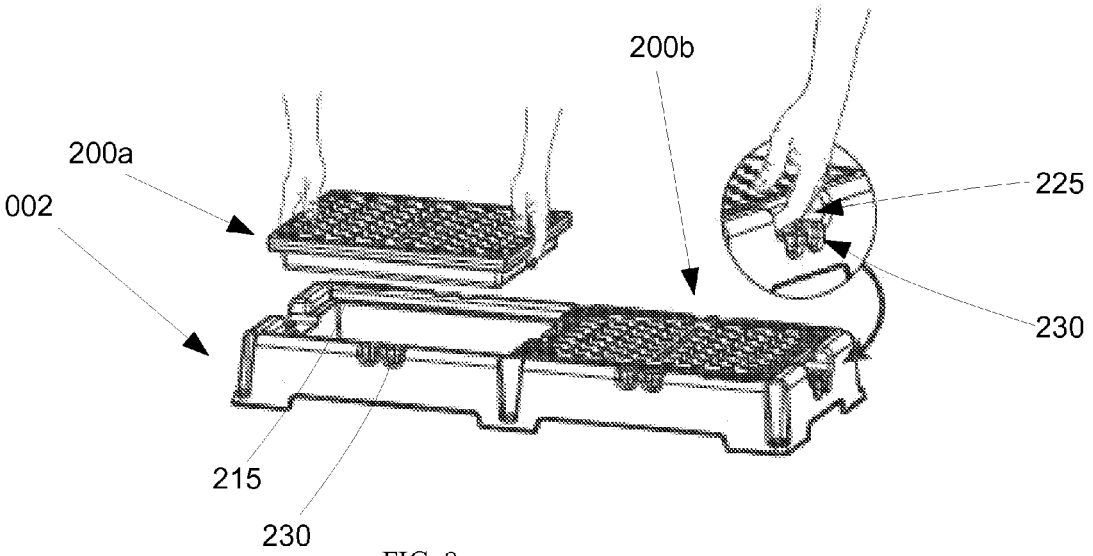
FIG. 8 shows a user removing and replacing a step unit on a two unit step apparatus.

FIG. 8 shows a user removing and replacing a step unit on a two unit step apparatus. The user sets flippable step unit 200*a* on inner ledge 215 for use. The user accesses flippable step unit 200*b* through access port 225 to remove the step unit 200*b*.

Figure 9:
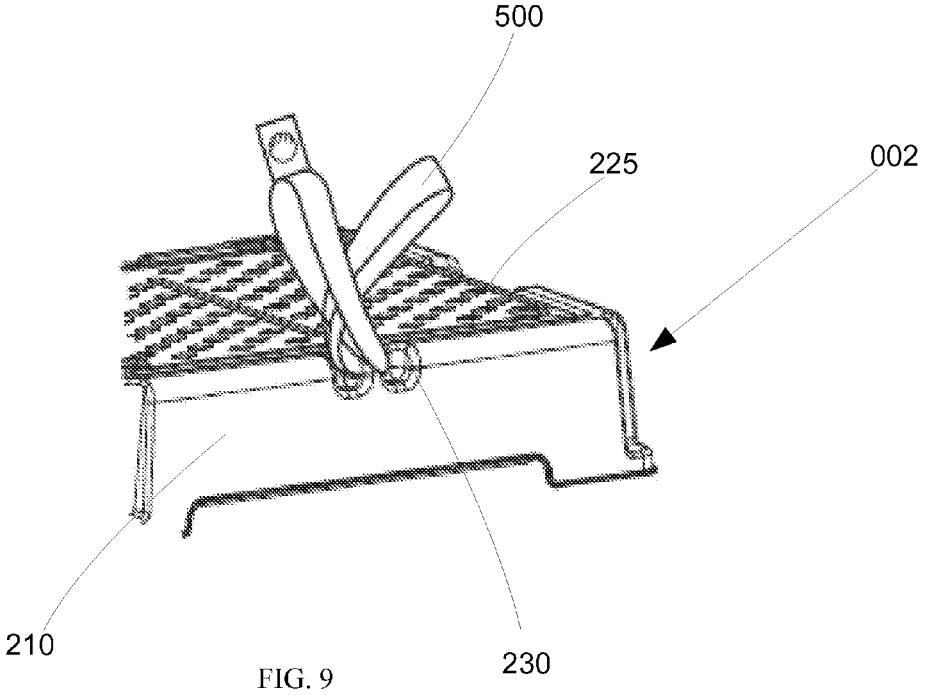
FIG. 9 shows an enlarged view of one side of the step apparatus with an attached accessory.

FIG. 9 shows an enlarged view of one side of the step apparatus 002 with an attached accessory 500 looped through attachment points 230 on frame 210. Examples of accessories include exercise bands, tubing, and cable. Examples of attachment points include one or more loops, hooks, posts, snaps, buckles, Velcro® and the like.

The entire step apparatus 001 may be made of a durable plastic and can be made by injection molding, or from molded pieces. Rubber pieces 020 may be added to the bottom of the stepper frame to reduce friction, so it does not slip during use. The embodiments in this disclosure are exemplary and should not be taken to be limiting. Any number of steps can be included. The frame and boxes can be made in any size or shape, and with any material which can perform equivalent to the apparatus of this disclosure.

This step apparatus may be used for individual training or group fitness classes. The stepper could be used by way of body weight or weighted resistance. The user may use a plurality of step heights in one unit for a dynamic work out. The step heights may also be adjusted to user preference.

What is claimed is:

1. A stepper apparatus, comprising:

a base structure comprising an elevated frame having an upper surface and having a divider wall separating the frame into two separate openings;

a ledge along at least a portion of the inside of the elevated frame;

at least two removable flippable platform units shaped to be received within the frame, wherein the platform units have a top exercise surface on a top surface thereof and a bottom exercise surface on a bottom surface thereof;

wherein each removable flippable platform unit comprising the top exercise surface is dimensioned to rest on the ledge within said frame such that said top exercise surface of said platform unit is substantially flush with said upper surface of said frame, and the bottom exercise surface has a length and width sized to pass through the ledge of said frame when said flippable platform unit is placed in said frame in a first configuration and when said flippable platform unit is placed in said frame in a second configuration, said bottom exercise surface of said platform unit extends substantially above said upper surface of said frame.

2. The stepper apparatus of claim 1, where the frame is adapted to stand on a floor.

3. The stepper apparatus of claim 2, where the frame has at least one non-slip contact with the floor.

4. The stepper apparatus of claim 1, where the stepper apparatus is made from a rigid material.

5. The stepper apparatus of claim 4, where the stepper apparatus is made from plastic.

6. The stepper apparatus of claim 1, wherein the top exercise surface has a rectangular cross section.

7. The stepper apparatus of claim 1, wherein each flippable platform unit has a different height.

8. The stepper apparatus of claim 1, where the frame is rectangular.

* * * * *